US006182465B1

(12) United States Patent
Ricci

(10) Patent No.: US 6,182,465 B1
(45) Date of Patent: Feb. 6, 2001

(54) TWO-PIECE COOLER ASSEMBLY

(75) Inventor: Paul A. Ricci, Bloomfield Hills, MI (US)

(73) Assignee: Box USA, Valhalla, NY (US)

( * ) Notice: Under 35 U.S.C. 154(b), the term of this patent shall be extended for 0 days.

(21) Appl. No.: 09/245,013

(22) Filed: Feb. 4, 1999

Related U.S. Application Data

(60) Provisional application No. 60/073,917, filed on Feb. 6, 1998.

(51) Int. Cl.[7] ..... F25D 3/08

(52) U.S. Cl. ..... 62/457.1; 62/371

(58) Field of Search ..... 62/371, 457.1, 62/457.7, 457.9

(56) References Cited

U.S. PATENT DOCUMENTS

| | | | | |
|---|---|---|---|---|
| 2,109,789 | * | 3/1938 | Bangs . | |
| 2,289,060 | * | 7/1942 | Merkle . | |
| 2,807,402 | * | 9/1957 | Nelbach . | |
| 2,810,506 | | 10/1957 | Kessler . | |
| 3,081,017 | * | 3/1963 | Gerbino . | |
| 4,084,740 | | 4/1978 | Lorenz . | |
| 4,196,843 | | 4/1980 | Garmon . | |
| 4,342,416 | | 8/1982 | Philips . | |
| 5,020,337 | | 6/1991 | Krieg . | |
| 5,094,359 | | 3/1992 | DeMars . | |
| 5,201,868 | * | 4/1993 | Johnson | 220/403 |
| 5,234,158 | | 8/1993 | Storms . | |
| 5,263,339 | | 11/1993 | Evans . | |
| 5,303,863 | | 4/1994 | Arasim . | |
| 5,582,343 | | 12/1996 | Dalvey . | |
| 5,820,268 | * | 10/1998 | Becker et al. | 383/99 |

* cited by examiner

*Primary Examiner*—William Doerrler
*Assistant Examiner*—Melvin Jones

(57) ABSTRACT

A two-piece box assembly includes a box insert and an outer shell portion which are for use as a portable cooler. The box insert and the outer shell portion are made from a precut blank that are folded into their final shape. The box insert is covered with a water and vapor resistant coating to allow the box assembly to hold water based products for extended periods of time without significant degradation of the two-piece box assembly.

20 Claims, 4 Drawing Sheets

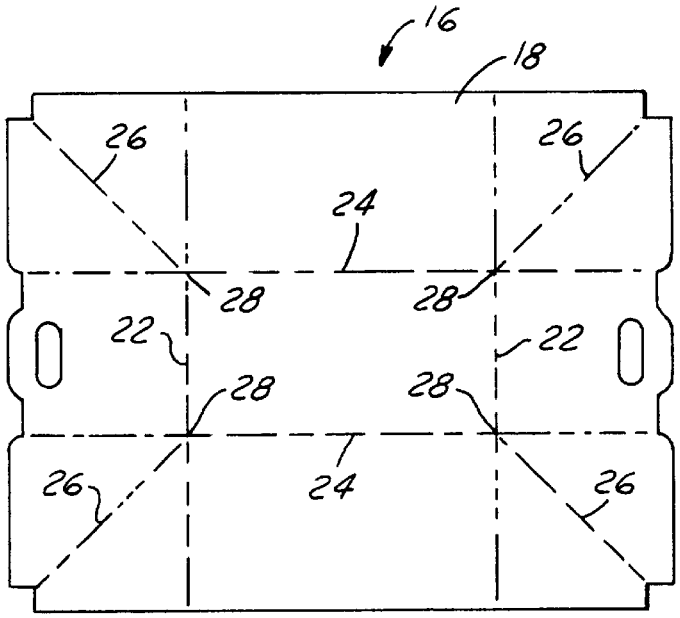
FIG. 1A
FIG. 1B
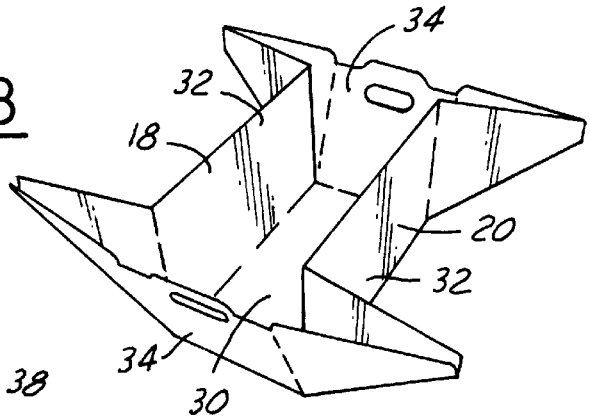
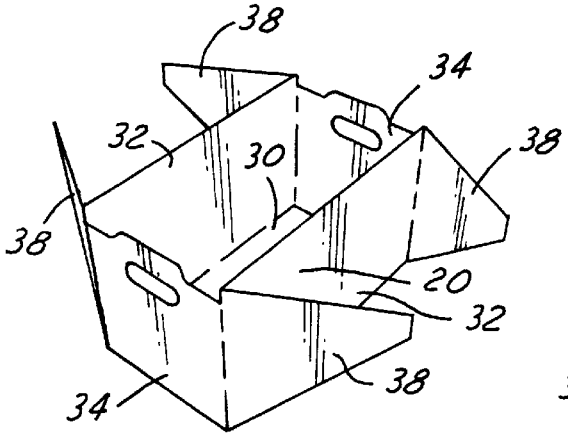
FIG. 1C
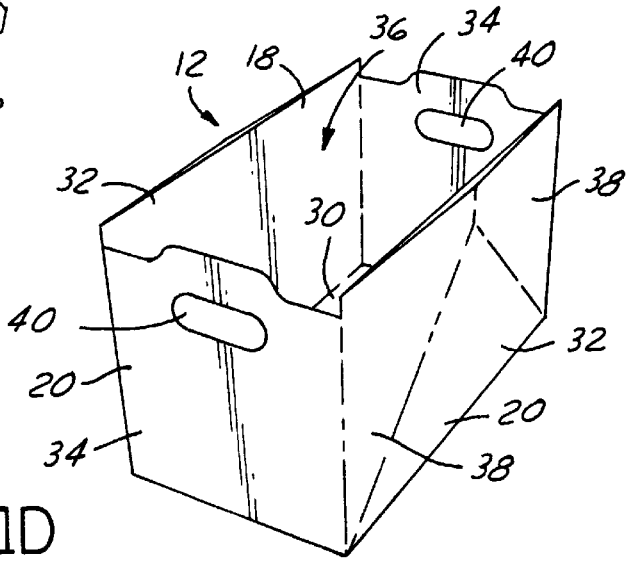
FIG. 1D

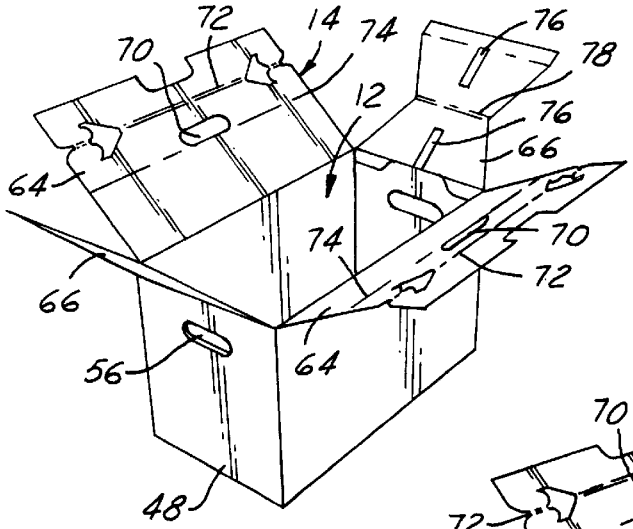
FIG. 4A
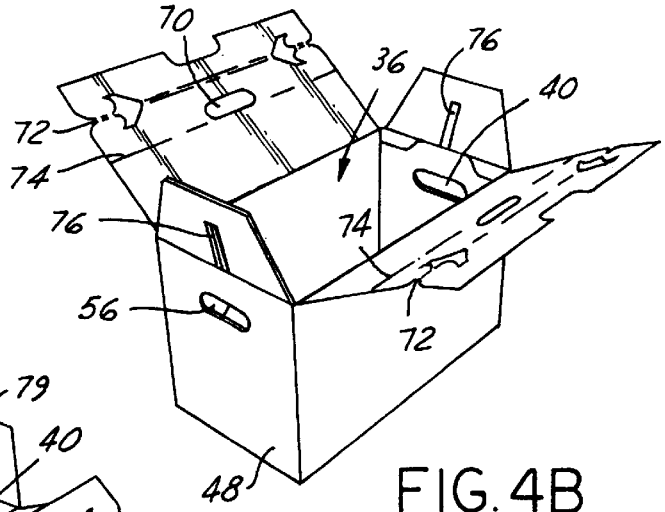
FIG. 4B
FIG. 4C
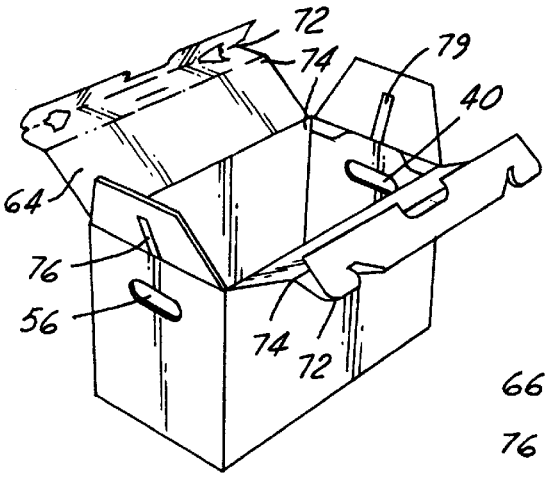
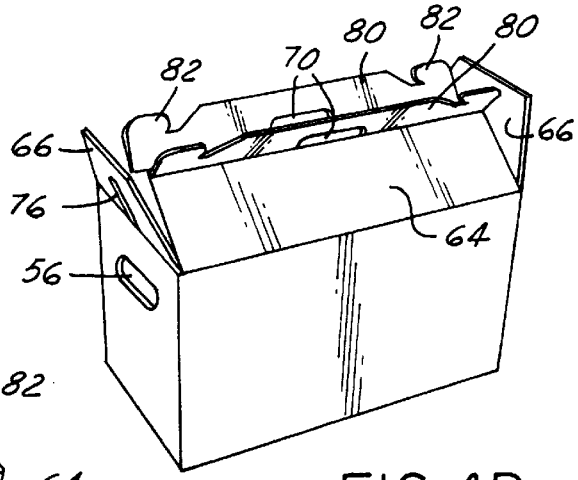
FIG. 4D
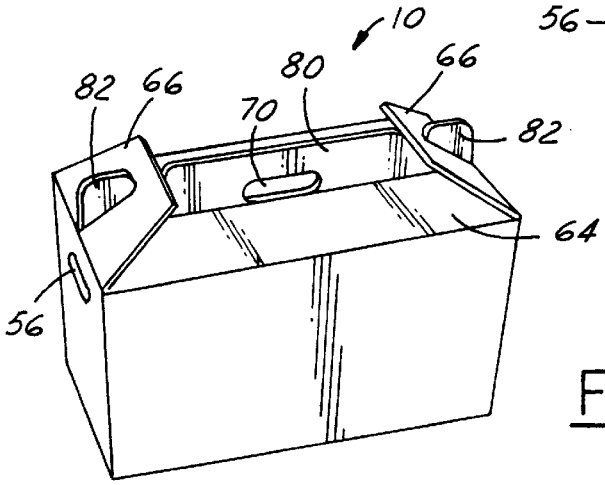
FIG. 4E

TWO-PIECE COOLER ASSEMBLY

CROSS-REFERENCE TO RELATED APPLICATIONS

The present application is a continuation of U.S. Provisional Application, Serial No. 60/073,917 filed Feb. 6, 1998, entitled "TWO-PIECE COOLER ASSEMBLY".

TECHNICAL FIELD

The present invention relates generally to portable coolers. More specifically, the present invention relates to a portable cooler of two-piece construction that allows beverages to be cooled in the container in which they are purchased.

BACKGROUND OF THE INVENTION

A conventional cooler or ice box is one common solution for the storage of items to be cooled and/or the transportation of items to be kept cool relative to ambient temperature. One typical application for the conventional cooler provides the capability of keeping beverages cool at a remote location. These coolers are typically filled with a cooling source, such as ice, as well as the desired beverage, whether in cans, bottles, or other types of containers. These coolers are also used to store other materials. The cooler satisfactorily insulates the items stored therein and thereby maintains the beverage at a relatively cool temperature over the course of a day.

The conventional cooler, however, is nonetheless inconvenient in certain respects. For example, the conventional cooler is somewhat expensive to purchase, is relatively cumbersome to handle and store, and is typically unavailable for use on spur of the moment. Moreover, typical coolers need to be purchased separate from the containers in which they are purchased, which adds additional cost. Thus, there exists room for improvement to known methods and apparatus for keeping items cooler than ambient temperature.

To solve some of these convenience problems, as well as availability of prior coolers, attempts have been made to provide portable coolers that also serve as the container that houses the beverages when purchased. These packages are typically constructed of cardboard and therefore when filled with ice, tend to lose their strength, and thus their portability over a period of time as the ice melts. Further, these portable coolers are also difficult to transport in that the handles do not provide sufficient strength to carry a full complement of beverages in their containers, as well as cooling means, such as ice. Accordingly, improvement is still necessary in the area of portable coolers that also serve as containers for the beverages or other items at point of purchase.

SUMMARY OF THE INVENTION

It is an object of the present invention to provide a portable cooler that is stronger, more durable, and less expensive than prior portable coolers of similar construction.

It is a further object of the present invention to provide a portable cooler constructed of a cardboard material that can hold beverages and ice for a period of at least 24 hours without significant degradation.

In accordance with the above and other objects of the present invention, a two-piece portable cooler for holding and transporting a plurality of beverage containers therein is provided. The portable cooler includes a first cardboard blank having an inner surface and an outer surface. The first cardboard blank has a plurality of fold lines thereon, allowing the first cardboard blank to be folded to form an outer shell piece. The resultant outer shell piece has a bottom portion, a pair of opposing side portions, a pair of opposing end portions, a carrying portion, and a cavity portion defined by the inner surface of the first cardboard blank after folding. The cooler also includes a second cardboard blank having an inner surface and an outer surface. The second cardboard blank has a plurality of fold lines thereon allowing the second cardboard blank to be folded to form an insert piece. The resultant insert piece has a bottom portion, a pair of opposing side portions, a pair of opposing end portions, and a cavity portion defined by the inner surface of the second cardboard blank. The inner surface of the second cardboard blank is coated with a water resistant or water barrier coating. The outer shell piece is designed to receive the insert portion in the outer shell piece cavity portion, such that the plurality of beverage containers may be cooled therein with ice or other cooling means without water or vapor being transferred to the outer shell piece and thereby minimizing degradation and bulging of the portable cooler.

Other objects and features of the present invention will become apparent when viewed in light of the detailed description of the preferred embodiment when taken in conjunction with the attached drawings and appended claims.

BRIEF DESCRIPTION OF THE DRAWINGS

FIG. 1(*a*) is a top view of a precut blank for use in forming a cooler insert in accordance with a preferred embodiment of the present invention;

FIG. 1(*b*) is a perspective view illustrating one step of the formation of the cooler insert from the precut blank of FIG. 1(*a*) in accordance with a preferred embodiment of the present invention;

FIG. 1(*c*) is a perspective view illustrating a further step of the formation of the cooler insert in accordance with a preferred embodiment of the present invention;

FIG. 1(*d*) is a perspective view of a cooler insert in a fully assembled position in accordance with a preferred embodiment of the present invention;

FIG. 3(*b*) is a perspective view illustrating the insertion of a cooler insert into an outer shell portion during the formation of a two-piece portable cooler assembly in accordance with a preferred embodiment of the present invention;

FIG. 3(*c*) is a perspective view of an assembled two-piece portable cooler assembly with the carrying portion open in accordance with a preferred embodiment of the present invention;

FIG. 3(*d*) is a perspective view of a two-piece portable cooler assembly with the carrying portion in a closed or stored position in accordance with a preferred embodiment of the present invention;

FIG. 4(*a*) is a perspective view illustrating the assembly of a carrying portion of a two-piece cooler assembly in an open position in accordance with a preferred embodiment of the present invention;

FIG. 4(*b*) is a perspective view illustrating one step of the assembly of the carrying portion of the two-piece cooler assembly for transport thereof in accordance with a preferred embodiment of the present invention;

FIG. 4(*c*) is a perspective view illustrating a further step in the assembly of the carrying portion of the two-piece cooler assembly with the opposing side flaps being brought together for transport thereof in accordance with a preferred embodiment of the present invention; and FIG. 4(*d*) and (*e*) is a perspective view of a fully assembled two-piece cooler assembly with the carrying portion of the two-piece cooler assembly in a transport position in accordance with a preferred embodiment of the present invention.

BEST MODE(S) FOR CARRYING OUT THE INVENTION

Figure 2:
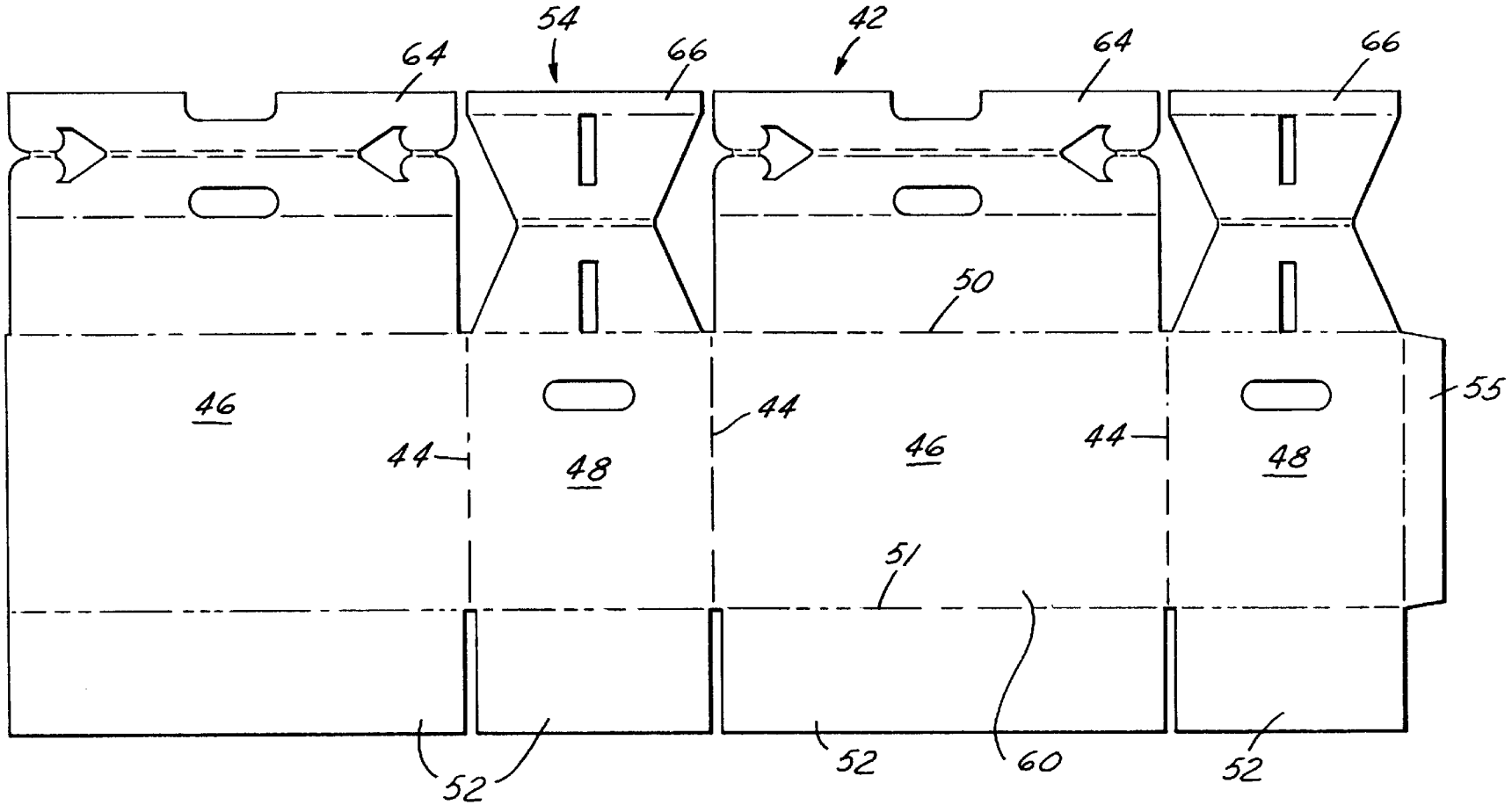
FIG. 2 is a top view of a precut blank for use in forming an outer shell portion of a portable cooler assembly in accordance with a preferred embodiment of the present invention.
Figure 3A:
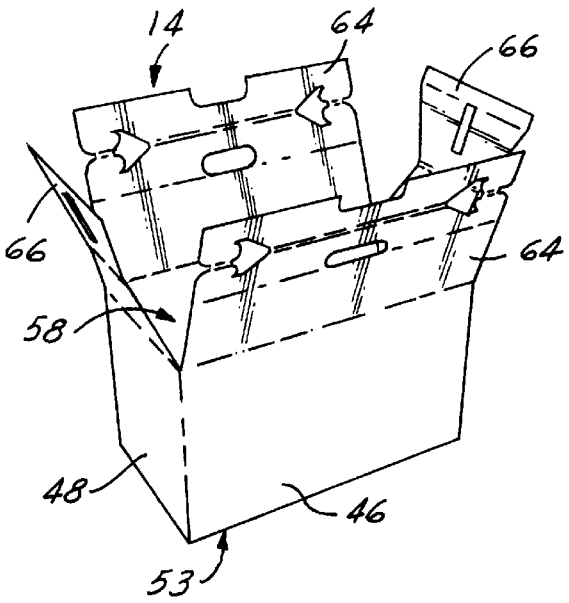
FIG. 3(*a*) is a perspective view of an assembled outer shell portion in accordance with a preferred embodiment of the present invention.
Figure 3B:
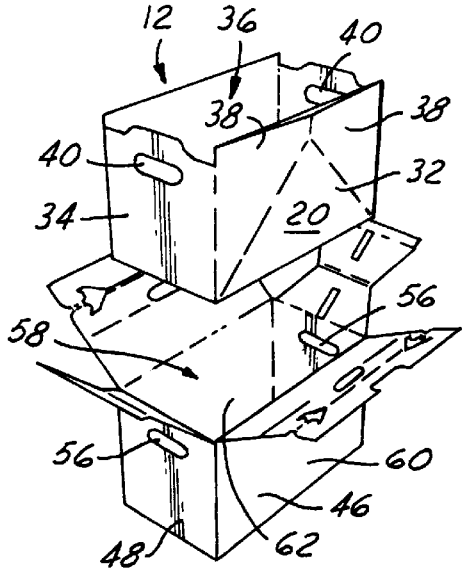
Figure 3C:
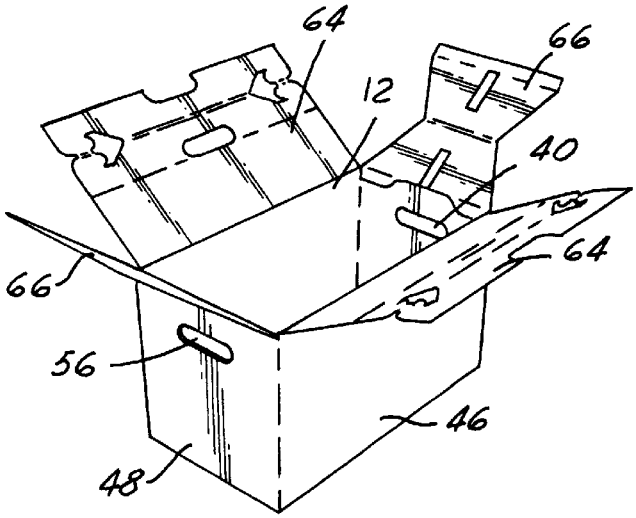
Figure 3D:
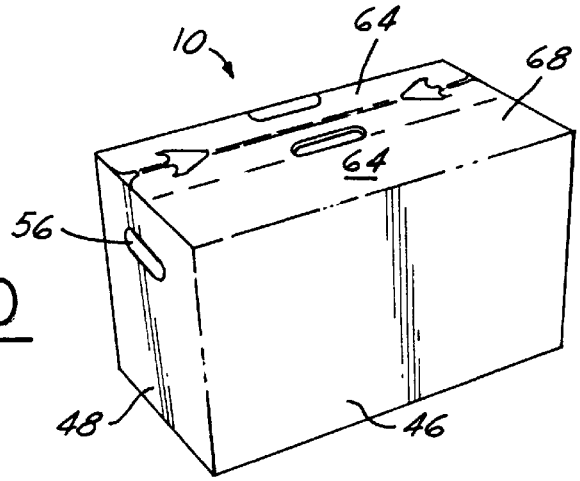

Turning now to FIGS. 1 through 4 which illustrate a two-piece box assembly 10 in accordance with a preferred embodiment of the present invention. The two-piece box assembly 10 disclosed herein, is preferably for use as a portable cooler, however, it may have a variety of other uses including, the transport of any material without leakage, such as waste materials. The two-piece box assembly 10 includes a first portion, which is a box insert 12 and a second portion, which is an outer shell portion 14.

FIG. 1(*a*) illustrates a precut insert blank 16 for use in forming the box insert 12 in accordance with the present invention. The precut insert blank 16 is preferably manufactured from a material, such as cardboard or the like. It should be understood that other suitable materials may be utilized. The precut insert blank 16 is initially formed having predetermined dimensions, including a predetermined length and a predetermined width, depending upon the size of the cooler or other device to be constructed. The precut insert blank 16 has an inner surface 18 and an outer surface 20. The inner surface 18 has a plurality of folds formed thereon such that the precut insert blank 16 can be erected or folded into the final shape of the box insert 12 (FIG. 1(*d*)).

The precut insert blank 16 has two vertical folds 22 formed in its inner surface 18, two horizontal folds 24 formed on its inner surface 18, and a plurality of diagonal folds 26 also formed on its inner surface 18. The diagonal folds are preferably disposed at each corner of the blank 16 and meet at the intersection 28 of the vertical folds 22 and horizontal folds 24. It should be understood that the fold lines may be formed by scoring, perforating, or other known methods of preparing the insert inner surface 18 to facilitate folding thereof into its final form as the box insert 12. Illustrative steps for transforming the insert cardboard blank 16 into the final shape of the box insert 12 are shown sequentially in FIGS. 1(*b*) through 1(*d*).

As shown in FIG. 1(*b*), the precut insert blank 16 is first folded along the two horizontal folds 24 and then folded along the two vertical folds 22. The same result can similarly be achieved by folding the vertical folds 22 before the horizontal folds 24. Once the precut insert blank 16 has been folded along the horizontal folds 24 and the vertical folds 22, a bottom wall 30 is formed from which a pair of opposing sidewalls 32 and a pair of opposing endwalls 34 depend. The bottom wall 30, the opposing sidewalls 32, and the opposing endwalls 34 define a storage area 36 for housing items such as beverage containers, cold cuts, or other items to be cooled therein.

As shown in FIG. 1(*c*), four generally triangular shaped corner pieces 38 extend away from the insert outer surface 20 during folding. The corner pieces 38 are preferably bisected by the diagonal folds 26 to allow easy formation of the box insert 12 from the precut insert blank 16. The corner pieces 38 are preferably folded against and secured to the insert outer surface 20 on each of the opposing sidewalls 32. The corner pieces 38 are preferably affixed by glue or other permanent securing means. The corner pieces 38 can also be secured to the opposing endwalls 34 only or a combination of both the opposing sidewalls 32 and the opposing endwalls 34. The corner pieces 38 must, however, be secured to the insert outer surface 20 of the box insert 12, to prevent any leakage of material from the storage area 36 and provide a seam free inner surface 18. It should be understood that the precut insert blank 16 may take on a variety of shapes and configurations.

The fully assembled box insert 12 is illustrated in FIG. 1(*d*) with the corner pieces 38 secured to the insert outer surface 20 along the opposing sidewalls 32. The box insert 12 also preferably has a handle opening 40 formed through each of the opposing endwalls 34 to allow easy grasping and transportation thereof. The handle openings 40 may obviously be positioned at different locations on the insert 12, however, it is preferred that the handles 40 align with corresponding handle openings positioned in the outer shell portion 14, as discussed herein below. The insert inner surface 18 preferably has a coating thereon. The coating must have sufficient water resistant and vapor barrier characteristics to allow the insert to house beverages or other items to be filled with ice, and remain intact for a significant period without loss of carrying ability. The coating is preferably Hydraban 1000, but any other suitable water resistant coating may be utilized. In the preferred embodiment, the coating provides sufficient characteristics, such that the two-piece cooler assembly 10 will remain intact without significant degradation and bulging and will allow for the carrying and transport of beverages for at least a period of 24 hours. Any of a variety of known water-resistant coatings may be utilized so long as the coating provides sufficient water resistant and vapor barrier characteristics which prevent the insert 12 from absorbing any water or other moisture without compromising the carrying, strength of the insert.

FIG. 2 is an illustration of a precut outer shell blank 42 for use in forming the outer shell portion 14 of the two-piece box assembly 10. As with the precut insert blank 16, the outer shell blank 42 is initially precut with predetermined dimensions, including a predetermined length and a predetermined width. The precut outer shell blank 42 is also preferably manufactured from a paper material, such as cardboard or the like. The precut outer shell blank 42 is preferably divided into four sections by a plurality of vertical fold lines 44. The vertical fold lines 44 separate the precut outer shell blank 42 into two opposing sidewalls 46 and two opposing endwalls 48. The precut outer shell blank 42 also has an upper horizontal fold line 50 and a lower horizontal fold line 51. The lower horizontal fold line 51 separates a respective bottom wall portion 52 from the opposing sidewalls 46 and the opposing endwalls 48. The upper horizontal fold line 50 separates the opposing sidewalls 46 and the opposing endwalls 48 from a carrying portion 54. Any number of horizontal or vertical fold lines may be utilized. The fold lines are preferably formed by scoring, cutting or the like.

The precut outer shell blank 42 is preferably first folded along the vertical fold lines 44 and then along the lower horizontal fold line 51 to form a bottom wall 53 of the outer shell portion 14 from the bottom wall portions 52. The portions of the bottom wall 52 are preferably secured together by glue or other fastening mechanisms or the like. Similarly, a tab portion 55 is secured to the inner surface of an adjacent side wall 46 by gluing or the like to form a storage area 58. The resultant assembly 14, as secured, is shown in FIG. 3(*a*). At least one handle portion 56 is formed in each of the opposing endwalls 48. After the outer shell portion 14 has been assembled, the opposing sidewalls 46 and the opposing endwalls 48 define an interior storage area 58 for receipt of the box insert 12 therein. FIG. 3(*b*) illustrates the insertion of the box insert 12 into the storage area 58 of the outer shell portion 14. The outer shell portion 14 has an inner surface 60 and an outer surface 62. The inner surface 60 of the outer shell portion 14 contacts the outer surface 20 of the box insert 12.

Once the box insert 12 has been placed inside the interior storage area 58 of the outer shell portion 14, the resultant two-piece box assembly 10 is formed, as depicted in FIG. 3(*c*) with the insert handle openings 40 in alignment with the handle openings 56 of the outer shell portion 14.

The carrying portion 54 of the two-piece box assembly 10 is comprised of two side flap portions 64 and two end flap portions 66. The two side flap portions 64 are preferably integral with and extend above the opposing side portions 46 of the outer shell portion 14. Similarly, the two end flap portions 66 are preferably formed integral with and extend above the opposing endwalls 48 of the outer shell portion 14. Turning now to FIG. 3(*d*), the carrying portion 56 is shown in a closed or stored position, such that the two-piece box assembly 10 has a generally flat top portion 68. In this configuration, the assembly 10 may act as a container to house beverage containers or other items for purchase. The assembly 10 may be packed onto a shelf with a plurality of similar assemblies stacked on top of one another or side by side. In order to form the generally flat top portion 68, the two end flap portions 66 are folded inward over the cooler storage area 36. The two side flap portions 64 are then folded inwardly one at a time in an overlapping fashion, such that one side flap portion 64 lies over top the other side flap portion 64.

Turning now to FIGS. 4(*a*) through 4(*d*) which illustrate the assembly of the carrying portion 54 for easy transport of the assembly 10. As shown in the Figures, the two side flap portions 64 each have an opening 70 formed therein. The two side flap portions 64 also have an upper horizontal fold line 72 and a lower horizontal fold line 74. The two end portions 66 each have a pair of slots 76 formed therein and a horizontal bisecting fold line 78. As shown in FIG. 4(*b*), the two end flap portions 66 are folded in half at the horizontal bisecting fold line 78, such that the pair of slots 76 formed therein overlap one another to form a single slot 76. The two side flap portions 64 are then folded over the upper horizontal fold lines 72 as shown in FIG. 4(*c*) to form upper handle portions 80. The two side flap portions 64 are then brought together, such that the upper handle portions 80 meet with the respective handle openings 70 in alignment. As shown in FIG. 4(*d*), the two end flap portions 66 are then brought into engagement with the flanges 82 positioned on either end of the upper handle portions 80. In this position, shown in FIG. 4(*e*), the flanges 82 pass through the slots 76 and the respective end flap portion 66 to secure the upper handle portions 80 and thus the carrying portion 54 so that the two piece box assembly 10 may be easily transported.

The cooler storage area 36 is intended to hold beverage containers and/or other items and ice for cooling the beverages and other items. The box insert 12 and its coating will prevent the ice and any water from the melted ice to pass through to the outer shell portion 14 for extended periods of time. In accordance with a preferred embodiment, the construction of the disclosed cooler will last for at least twenty four (24) hours without significant degradation of the cooler. This will allow it to be used and transported for extended periods.

While the best modes for carrying out the invention have been described in detail, those familiar with the art to which this invention relates will recognize various alternative designs and embodiments for practicing the invention as defined by the following claims.

What is claimed is:

1. A portable cooler, comprising:

an outer shell portion, said outer shell portion including a base portion, a pair of opposing side portions, and a pair of opposing end portions, said base portion, said pair of opposing side portions, and said pair of opposing end portions defining a cavity therein;

a handle portion in communication with said outer shell portion, said handle portion being movable between an open position wherein said cavity is exposed and a closed position allowing said cooler assembly to be grasped and transported; and an insert portion positioned within said cavity, said insert having a pair of opposing side portions that are aligned with said pair of opposing side portions of said outer shell portion, and a pair of opposing end portions that are aligned with said pair of opposing end portions of said insert portion each having an inner surface and an outer surface, said inner surface of said opposing end portions and said opposing side portions having a water-resistant barrier coating;

wherein said insert portion is constructed of a paper material and has a handle opening formed in each of said opposing end walls.

2. The portable cooler of claim 1, wherein said insert portion is constructed of cardboard.

3. The portable cooler of claim 2, wherein said insert portion is initially precut as a cardboard blank with a plurality of folds allowing it to be erected into shape and positioned within said cavity.

4. The portable cooler of claim 3, wherein said insert portion includes a plurality of corner pieces that are affixed to either the opposing end portions or the opposing side portions.

5. The portable cooler of claim 2, wherein said outer shell portion has a handle opening formed in each of said opposing end walls, and wherein each of said handle openings in said outer shell portion aligns with each of said handle openings formed in said insert portion when said insert portion is positioned in said cavity.

6. The portable cooler of claim 1 wherein said outer shell portion is constructed of a heavy paper material.

7. The portable cooler of claim 6, wherein said outer shell portion is constructed of cardboard.

8. The portable cooler of claim 7, wherein said outer shell portion and said handle portion are initially precut as an integral cardboard blank with a plurality of folds allowing there to be folded into shape.

9. A portable cooler for holding and transporting a plurality of items to be cooled therein; comprising:

a first cardboard blank having an inner surface and an outer surface; said first cardboard blank having a plurality of fold lines thereon allowing said first cardboard blank to be folded therealong to form an outer shell portion having a bottom portion, a pair of opposing side portions, a pair of opposing end portions, a carrying portion, and a cavity portion;

a second cardboard blank having an inner surface and an outer surface, said second cardboard blank having a plurality of fold lines thereon allowing said second cardboard blank to be folded therealong to form an insert portion having a bottom portion, a pair of opposing side portions, a pair of opposing end portions, and a cavity portions;

said inner surface of said second cardboard blank being coated with a water-resistant coating;

whereby when said insert portion is positioned in said cavity portion of said outer shell portion, said plurality of items to be cooled may be cooled therein with ice or other cooling means.

10. The portable cooler of claim 9, wherein said outer shell portion has a handle opening formed in each of said opposing end walls.

11. The portable cooler of claim 9, wherein said outer shell portion has a handle opening formed in each of said opposing end walls.

12. The portable cooler of claim 10, wherein said insert portion has a handle opening formed in each of said opposing end walls for lining up with handle openings formed in said outer shell portion.

13. The portable cooler of claim 9, wherein said carrying portion further comprises:

a pair of side flap portions extending from each of said opposing side portions of said outer shell portion; and a pair of end flap portions extending from each of said opposing end portions of said outer shell portion;

wherein said pair of end flap portions are designed to engage and secure said pair of side flap portions.

14. The portable cooler of claim 13, wherein each of said side flap portions have a handle portion formed therethrough, such that when secured by said end flap portions, said handle portions are aligned and allow for transporting of said portable cooler.

15. A method for constructing a portable cooler, comprising:

providing a first cardboard blank having an inner surface and an outer surface;

folding said first cardboard blank into an outer shell portion, having a bottom surface, a pair of opposing side surfaces, a pair of opposing end surfaces, a carrying portion, and a cavity defined by said cardboard blank inner surface;

providing a second cardboard blank having an inner surface and an outer surface;

coating said inner surface of said second cardboard blank with a water-resistant coating;

folding said second cardboard blank into an insert portion, having a bottom surface, a pair of opposing side surfaces, a pair of opposing end surfaces, and a beverage container receptacle defined by said inner surface of said second cardboard blank;

inserting said insert portion into said outer shell portion; and securing said carrying portion such that said portable cooler may be grasped and transported.

16. The method of claim 15, wherein said portable cooler is designed to hold and cool a plurality of beverage containers without degradation of said cooler for a period of at least twenty-four hours.

17. The method of claim 15, wherein said outer shell portion has a handle opening formed in each of said opposing end walls.

18. The method of claim 17, wherein said insert portion has a handle opening formed in each of said opposing end walls, and which line up with a respective handle opening formed in said outer shell portion after said insert portion has been inserted into said outer shell portion.

19. A portable cooler, comprising:

an outer shell portion, said outer shell portion including a base portion, a pair of opposing side portions, and a pair of opposing end portions, said base portion, said pair of opposing side portions, and said pair of opposing end portions defining a cavity therein;

a handle portion in communication with said outer shell portion, said handle portion being movable between an open position wherein said cavity is exposed and a closed position allowing said cooler assembly to be grasped and transported; and an insert portion positioned within said cavity, said insert having a pair of opposing side portions that are aligned with said pair of opposing side portions of said outer shell portion, and a pair of opposing end portions that are aligned with said pair of opposing end portions of said insert portion each having an inner surface and an outer surface, said inner surface of said opposing end portions and said opposing side portions having a water-resistant barrier coating;

wherein said insert portion is initially precut as a cardboard blank with a plurality of folds allowing it to be erected into shape and position within said covering.

20. The portable cooler of claim 19, wherein said insert portion includes a plurality of corner pieces that are affixed to either said opposing end portions or said opposing side portions.

* * * * *